US009316069B2

(12) United States Patent
Zhang et al.

(10) Patent No.: US 9,316,069 B2
(45) Date of Patent: Apr. 19, 2016

(54) GUIDE DEVICE FOR COILED TUBING

(75) Inventors: Sanpo Zhang, Jingzhou (CN); Tieli Liu, Jingzhou (CN); Zaisi Zhu, Jingzhou (CN); Dafei Wu, Jingzhou (CN); Gang Luo, Jingzhou (CN)

(73) Assignees: China National Petroleum Corporation (CN); Drilling Research Institute, CNPC (CN); Jianghan Machinery Research Institute, DR, CNPC (CN)

( * ) Notice: Subject to any disclaimer, the term of this patent is extended or adjusted under 35 U.S.C. 154(b) by 316 days.

(21) Appl. No.: 14/111,461

(22) PCT Filed: Apr. 13, 2012

(86) PCT No.: PCT/CN2012/000510

§ 371 (c)(1), (2), (4) Date: Oct. 11, 2013

(87) PCT Pub. No.: WO2012/146053

PCT Pub. Date: Nov. 1, 2012

(65) Prior Publication Data

US 2014/0048249 A1 Feb. 20, 2014

(30) Foreign Application Priority Data

Apr. 28, 2011 (CN) ..... 2011 1 0108451
Apr. 28, 2011 (CN) ..... 2011 2 0129921 U

(51) Int. Cl.
*E21B 19/24* (2006.01)
*E21B 19/22* (2006.01)

(52) U.S. Cl.
CPC ..... *E21B 19/24* (2013.01); *E21B 19/22* (2013.01)

(58) Field of Classification Search
CPC ..... E21B 19/22; E21B 19/24
See application file for complete search history.

(56) References Cited

U.S. PATENT DOCUMENTS

2008/0314580 A1 12/2008 Wood
2010/0018693 A1 1/2010 Duncan et al.

FOREIGN PATENT DOCUMENTS

CN 101443527 A 5/2009
CN 201650162 U 11/2010
CN 102182409 A 9/2011
CN 202073514 U 12/2011

OTHER PUBLICATIONS

"International Application No. PCT/CN2012/000510, International Search Report issued Jul. 19, 2012", 6 pgs.

*Primary Examiner* — Giovanna C Wright
*Assistant Examiner* — Kristyn Hall
(74) *Attorney, Agent, or Firm* — Schwegman, Lundberg & Woessner, P.A.

(57) ABSTRACT

A coiled tubing guide-in device is applied to oil field coiled tubing operation and used for guiding a coiled tubing into injector head gripper blocks. The coiled tubing guide-in device mainly consists of a slip connecting head, a locking sleeve, a floating sleeve, a guide head, and a traction steel rope. In the structure of the slip connecting head, a cone of an expansion plug is arranged in a slip sleeve. A lower end of a tightening nut is a convex spherical body. At a lower end of the tightening nut, an end of a traction steel rope is fixed in a rectangular groove at the lower end of the tightening nut through a threaded pin. In the structure of the locking sleeve, an upper end surface of a spherical support body is a concave spherical surface. An inner conical sleeve and an outer conical clamping sleeve are arranged in a cylindrical space. A spherical head is fixed on inner screw threads of the spherical support body. The number of combined locking bodies ranges from 4 to 15. A lower end of the floating sleeve at the lowest end is connected with a conical guide body through the traction steel rope. The effect is that the coiled tubing is fast and safely pulled out of a tubing reel and guided into the injector head gripper blocks through a guider.

4 Claims, 7 Drawing Sheets

GUIDE DEVICE FOR COILED TUBING

BACKGROUND OF THE INVENTION

1. Field of Invention

The present invention relates to the technical field of oil field coiled tubing operation, and in particular, to a dedicated coiled tubing guide-in tool, namely, a coiled tubing guide-in device, capable of pulling a coiled tubing out of a tubing reel and guiding the coiled tubing into injector head gripper blocks.

2. Related Art

Currently, a coiled tubing unit is dedicated equipment used for oil-gas well operation, which mainly consists of a tubing reel (coiling coiled tubing), an injector head (which clamps the coiled tubing through the gripper blocks and injects the coiled tubing into the oil-gas well or lifts the coiled tubing out of the oil-gas well), and a power control system. During an installation process of the device at the well site, the coiled tubing on the tubing reel must be pulled out and inserted into the injector head gripper blocks before the subsequent installation operations are performed. However, before the coiled tubing pulled out of the tubing reel is put into an injector head guider, the coiled tubing must be straightened through an external force, and before the coiled tubing enters the injector head gripper blocks through the gooseneck guider, the coiled tubing is bended along with an are surface of the gooseneck guider. After that, the coiled tubing is inserted in the injector head gripper blocks.

Currently, two common methods are used. One method is a snake-rope coiled tubing guide-in device, in which a steel wire rope (referred to as a snake in other countries) with a radius being the same as that of an external radius of the coiled tubing is used. On end of the steel wire rope is connected to the coiled tubing on the reel through a special joint, and the other end is inserted in the injector head gripper blocks. An injector head motor is then started to guide the steel wire rope into the injector head. Finally, the coiled tubing is guided into the injector head, the steel wire rope and the joint are sawed from the coiled tubing, and the snake-rope guide-in device is dismounted, thereby completing the guide-in process of the coiled tubing. Such a steel wire rope guide-in tool has a firm joint connection, the strength thereof is well beyond the use requirement, and the rigidity is also appropriate. Therefore, the tool is safe to use. The deficiency thereof lies in that, after the coiled tubing is guided into the injector head, the snake-rope guide-in device cannot be taken down until the connection joint and the coiled tubing head are cut off, which wastes the expensive coiled tubing and causes inconvenience in use. In addition, for a coiled tubing with a great diameter (the diameter above 2⅜"), such a snake-rope guide-in device provides poor flexibility in operation, which directly affects the pipe guide efficiency. In ordinary operation well sites, it is generally required that a distance from the injector head to the tubing reel be greater than 10 m. As a result, the weight of the guide-in device, which uses solid steel as a main material, is increased dramatically. The guide-in device becomes clumsy, increases the labor intensity of workers, and is inconvenient to operate. The second method is a winch coiled tubing guide-in device. The operation principle is as follows: a thin steel wire rope with sufficient strength is used, an end thereof passes through gripper blocks and is fixed on the coiled tubing through a joint, and the other end passes through a blow-out preventer and is fixed on a winch. The winch is rotated through an external power source, so as to pull out the coiled tubing and finally guide the coiled tubing out of the stuffing box, thereby releasing the guide-in tool. The winch coiled tubing guide-in device provides desirable flexibility and reduces the labor intensity of workers, however, it requires an external power source and is inconvenient to use on site.

SUMMARY OF THE INVENTION

The present invention is directed to a coiled tubing guide-in device, which uses power source provided by an injector head motor of a coiled tubing unit, and is capable of fast and safely pulling a coiled tubing out of a tubing reel, and guiding the coiled tubing into injector head gripper blocks through a guider. Creative structural improvement is achieved based on the two existing coiled tubing guide-in tools, and advantages of the two existing tools are integrated, so as to enhance the operability and convenience and reduce the overall weight while ensuring sufficient flexibility and rigidity. Moreover, after the coiled tubing is guided into the injector head, the coiled tubing guide-in device and the connection joint are removed quickly and conveniently without damaging the coiled tubing.

The technical solution of the present invention is a coiled tubing guide-in device, which mainly consists of a slip connecting head, a locking sleeve, a floating sleeve, a guide head, and a traction steel rope.

The slip connecting head mainly consists of an expansion plug, a slip sleeve, and a tightening nut. The expansion plug consists of a cone and screw thread body. The cone is connected with the screw thread body. Center lines of the cone and the screw thread body are on the same straight line. A major diameter end of the cone at an end of the expansion plug is at an external end, that is, a minor diameter end of the cone is connected to an end of the screw thread body of the expansion plug, and the screw thread body is cylindrical and is provided with screw threads on an outer wall. The slip sleeve is cylindrical. An outer wall of the slip sleeve is provided with ring teeth, and an inner wall of the slip sleeve is a conical surface. A taper of the conical surface of the slip sleeve is the same as that of the cone of the expansion plug. The cone of the expansion plug is in the slip sleeve. A wall of the slip sleeve is provided with an axial gap. The cone of the expansion plug is capable of expanding the slip sleeve, that is, enabling a diameter of the outer wall of the slip sleeve to expand outward. The screw thread body of the expansion plug is connected with the tightening nut, and an upper end surface of the tightening nut contacts with a lower end surface of the slip sleeve. An outer wall of the tightening nut is cylindrical, and an end of the tightening nut is provided with inner screw threads, which are capable of being connected with the screw thread body of the expansion plug 1. A lower end of the tightening nut is a convex spherical body, and the lower end of the tightening nut is provided with a rectangular groove along an axial direction. A rope loop at an end portion of the traction steel rope is capable of being inserted in the rectangular groove. The lower end of the tightening nut is provided with a screw hole, and the screw hole is perpendicular to the rectangular groove at the lower end of the tightening nut. A threaded pin is fixed in the screw hole at the lower end of the tightening nut. An end portion of the threaded pin passes through the rope loop of the traction steel rope, to fix an end of the traction steel rope in the rectangular groove at the lower end of the tightening nut.

In order to rotate the tightening nut, the outer wall at the lower end of the slip sleeve is provided with six wrench grooves, and the outer wall at an upper end of the tightening nut is provided with six wrench grooves. The inner screw threads of the tightening nut and the external screw threads of the screw thread body of the expansion plug are trapezoidal screw threads. An end of the threaded pin is a polish rod, connection screw threads are provided in the middle, and another end is provided with an Allen wrench groove.

The locking sleeve mainly consists of a spherical support body, an inner conical sleeve, an outer conical clamping sleeve, a preloaded nut and a spherical head. The spherical support body is cylindrical, an upper end surface of the spherical support body is a concave spherical surface, and a center hole is provided at the center of the concave spherical surface. The traction steel rope is capable of passing through the center hole of the concave spherical surface. A cylindrical space is provided at a lower portion of the center hole in the spherical support body, and center lines of the cylindrical space and the spherical support body are on the same straight line. The inner conical sleeve and the outer conical clamping sleeve are arranged in the cylindrical space. An outer wall of the inner conical sleeve is cylindrical, a conical hole is provided in the inner conical sleeve, and the outer conical clamping sleeve is arranged in the conical hole in the inner conical sleeve. The outer conical clamping sleeve consists of two same gripper blocks, opposite rear outer walls of the two gripper blocks are conical, and ring teeth are provided on a wall of the center hole. When the traction steel rope passes through the center hole of the outer conical clamping sleeve and the outer conical clamping sleeve slides upward in the inner conical sleeve, the ring teeth of the outer conical clamping sleeve clamp the traction steel rope. Inner screw threads are provided at the lower end of the spherical support body. The preloaded nut is disposed on the inner screw threads of the spherical support body. An outer wall of the preloaded nut is provided with screw threads. The preloaded nut is provided with a center hole, and the traction steel rope is capable of passing through the center hole of the preloaded nut. The preloaded nut is capable of pushing the outer conical clamping sleeve to slide upward and clamp the traction steel rope. The spherical head is fixed on the inner screw threads of the spherical support body; the spherical head is cylindrical. An outer diameter of the spherical head is the same as that of the spherical support body. A cylinder of external screw threads is protruded from an upper end surface of the spherical head, and the external screw threads are capable of being connected to the inner screw threads of the spherical support body. A lower end of the spherical head is provided with a convex spherical body. The spherical head is provided with a center hole. The traction steel rope is capable of passing through the center hole of the convex spherical surface of the spherical support body. The traction steel rope passes through the center hole of the spherical support body, the center hole of the outer conical clamping sleeve, the center hole of the preloaded nut and the center hole of the spherical head. The convex spherical body at the lower end of the tightening nut is in the concave spherical surface at an upper end of the spherical support body.

The floating sleeve is formed of connected screw threads of the spherical support body and the spherical head. The traction steel rope passes through the center hole of the spherical support body of the floating sleeve and the center hole of the spherical head of the floating sleeve.

One locking sleeve and one or two floating sleeves form a group of combined locking body, and are connected through the traction steel rope. The convex spherical surface is inserted in the concave spherical surface. The convex spherical surface and the concave spherical surface slide freely, preventing articulations from being locked during work. The number of combined locking bodies ranges from 4 to 15. A lower end of the floating sleeve at the lowest end is connected with a conical guide body through the traction steel rope.

The guide head consists of the spherical support body, the inner conical sleeve, the outer conical clamping sleeve, the preloaded nut and the conical guide body. The structure of the guide head is substantially the same as that of the locking sleeve, and a difference is that the conical guide body is conical, an upper outer diameter of the conical guide body is the same as an outer diameter of the spherical support body, and a lower end of the conical guide body is provided with a convex spherical body. The conical guide body is provided with a center hole, and the traction steel rope passes through the center hole of the conical guide body. The conical guide body is capable of smoothly guiding the traction body into the gripper blocks.

Referring to FIG. 1, a use process of the coiled tubing guide-in device is briefly introduced as follows. The expansion plug 1 is placed into the slip sleeve 2, and the expansion plug 1 is enabled to match the slip sleeve 2 inside and outside. The tightening nut 3 is rotated, and a part of the outer diameter, where the ring teeth are provided, at the upper portion of the slip sleeve 2 is not expanded. The slip connecting head is assembled. An end, with the ring teeth on the outer wall, of the slip connecting head is inserted in the end portion of the coiled tubing located in the tubing reel, and tools such as a pipe wrench is used to screw the tightening nut, so that the slip connecting head is firmly connected with the coiled tubing and does not escape.

The floating sleeve and the locking sleeve, and the guide head and the traction steel rope 11 are assembled to form a traction body. One or two floating sleeves are disposed between every two locking sleeves. When the locking sleeves are assembled, the traction steel rope 11 passes through the spherical support body 5, the outer conical clamping sleeve 7, the preloaded nut 8 and the spherical head 9 in sequence, and after location adjustment, the outer conical clamping sleeve 7 clamps the traction steel rope 11 and places the traction steel rope 11 into the inner conical sleeve 6. Then the inner conical sleeve 6 is placed into the cylindrical space (stop groove) of the spherical support body 5. The preloaded nut 8 is screwed in until the traction steel rope 11 is tightly clamped. Finally, the spherical head 9 is connected. The floating sleeves are connected in series on the traction steel rope 11, and then the locking sleeve is mounted. Such an assembling process is repeated until a required length is reached, and then the guide head is mounted. The assembly of the guide head is the same as that of the locking sleeve. The total accumulated interval between the locking sleeves is controlled at about 30 mm, so as to improve the degree of freedom in articulations, and prevent the articulations from being locked during the pipe guide-in process.

The traction body formed of the locking sleeves, the floating sleeves, the guide head and the traction steel rope is connected to the slip connecting head already mounted on the coiled tubing through a threaded pin 4. The guide head is straightly inserted in a blow-out preventer through a gooseneck guider of the injector head and the gripper blocks, and finally passes out of the blow-out preventer at a bottom portion thereof. An injector head chain clamping hydraulic cylinder is started to clamp the traction body of the guide-in device. An injector head motor is started, the motor drives the chain, the chain drives the gripper blocks, and the gripper blocks drive the guide-in device. The guide-in device drives the coiled tubing to move toward the down pipe direction. Under the traction of the guide-in device, the coiled tubing is bended at the gooseneck guider, and then enters the gripper blocks. The coiled tubing is clamped by the gripper blocks and driven to move downward, and finally passes out of the blow-out preventer. The threaded pin 4 is first dismounted and the traction body is removed. Then the tightening nut 3 is released. The expansion plug 1 is tapped slightly so as to exit. The slip connecting head is removed. The pipe guide-in operation is finished.

Figure 1:
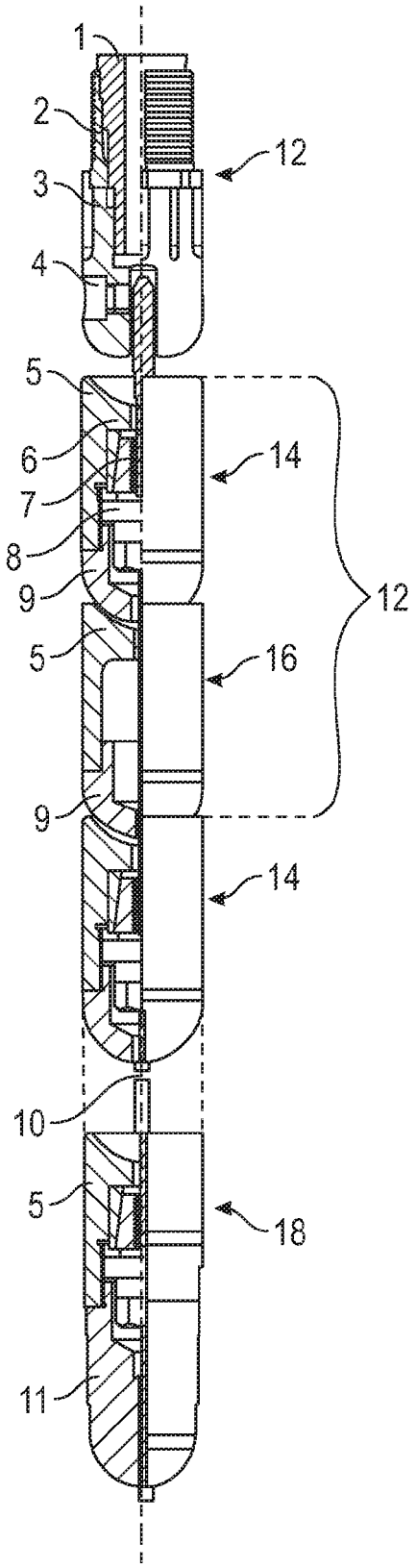
FIG. 1 is a schematic sectional view of an overall structure of a coiled tubing guide-in device according to the present invention.
Figure 2:
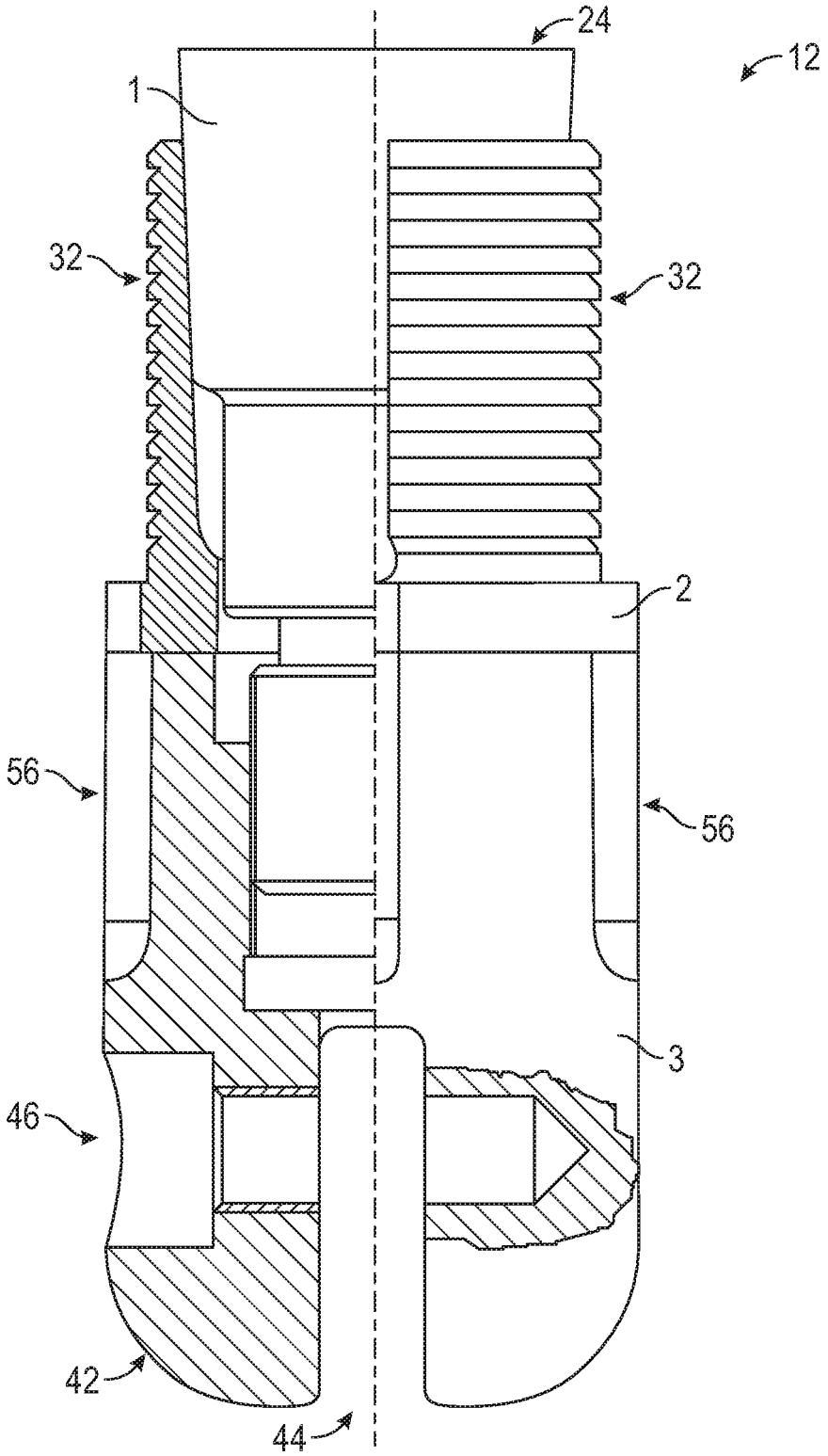
FIG. 2 is a schematic sectional structural view of a slip connecting head according to the present invention.
Figure 3:
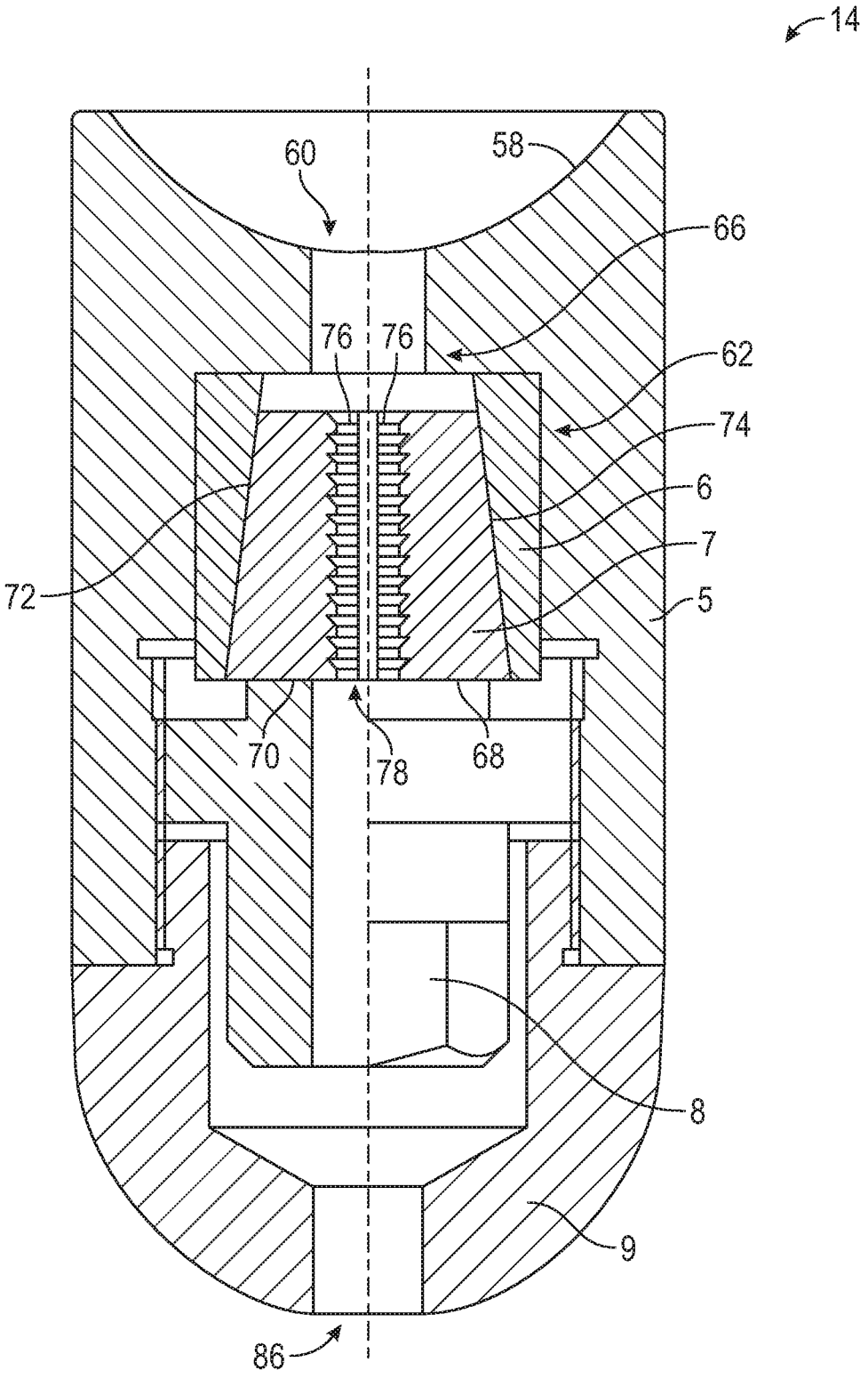
FIG. 3 is a schematic sectional structural view of a locking sleeve according to the present invention.
Figure 4:
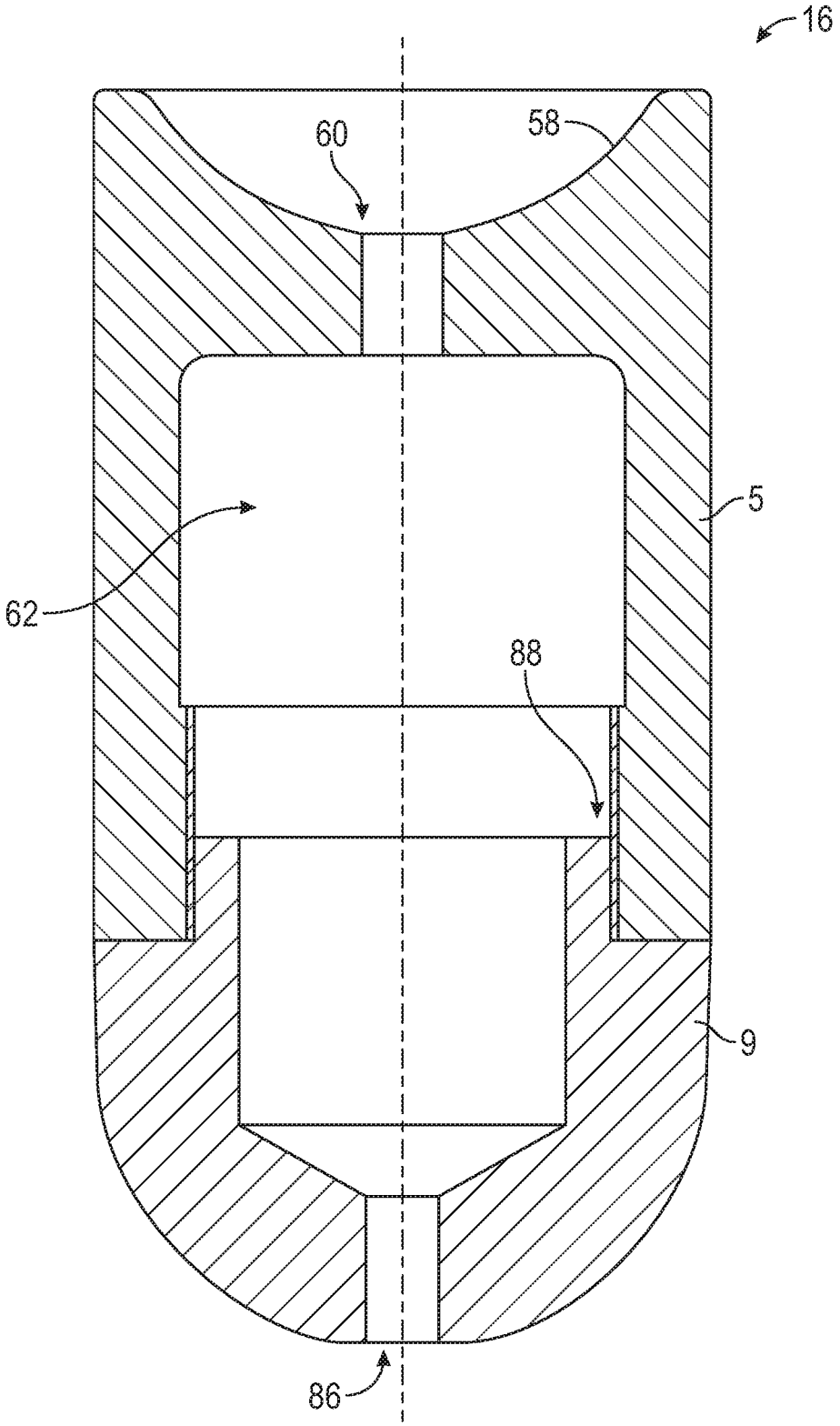
FIG. 4 is a schematic sectional structural view of a floating sleeve according to the present invention.
Figure 5:
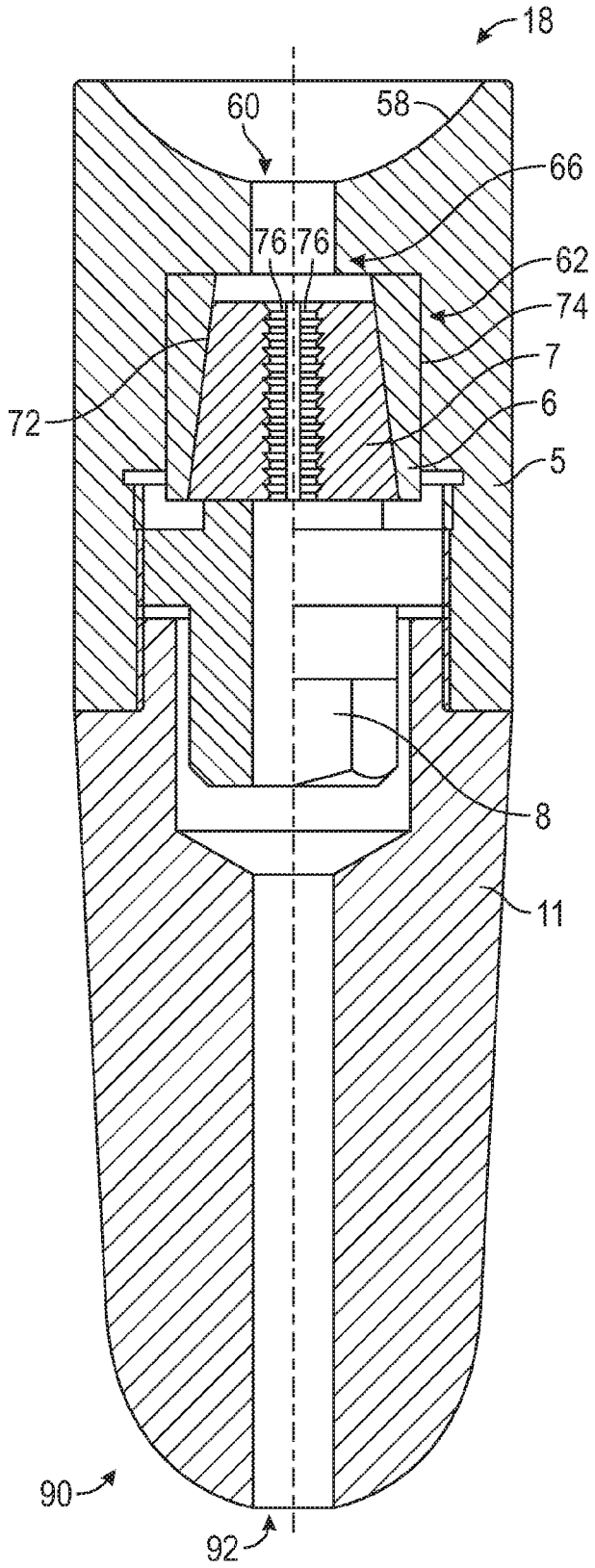
FIG. 5 is a schematic sectional structural view of a guide head according to the present invention.
Figure 6:
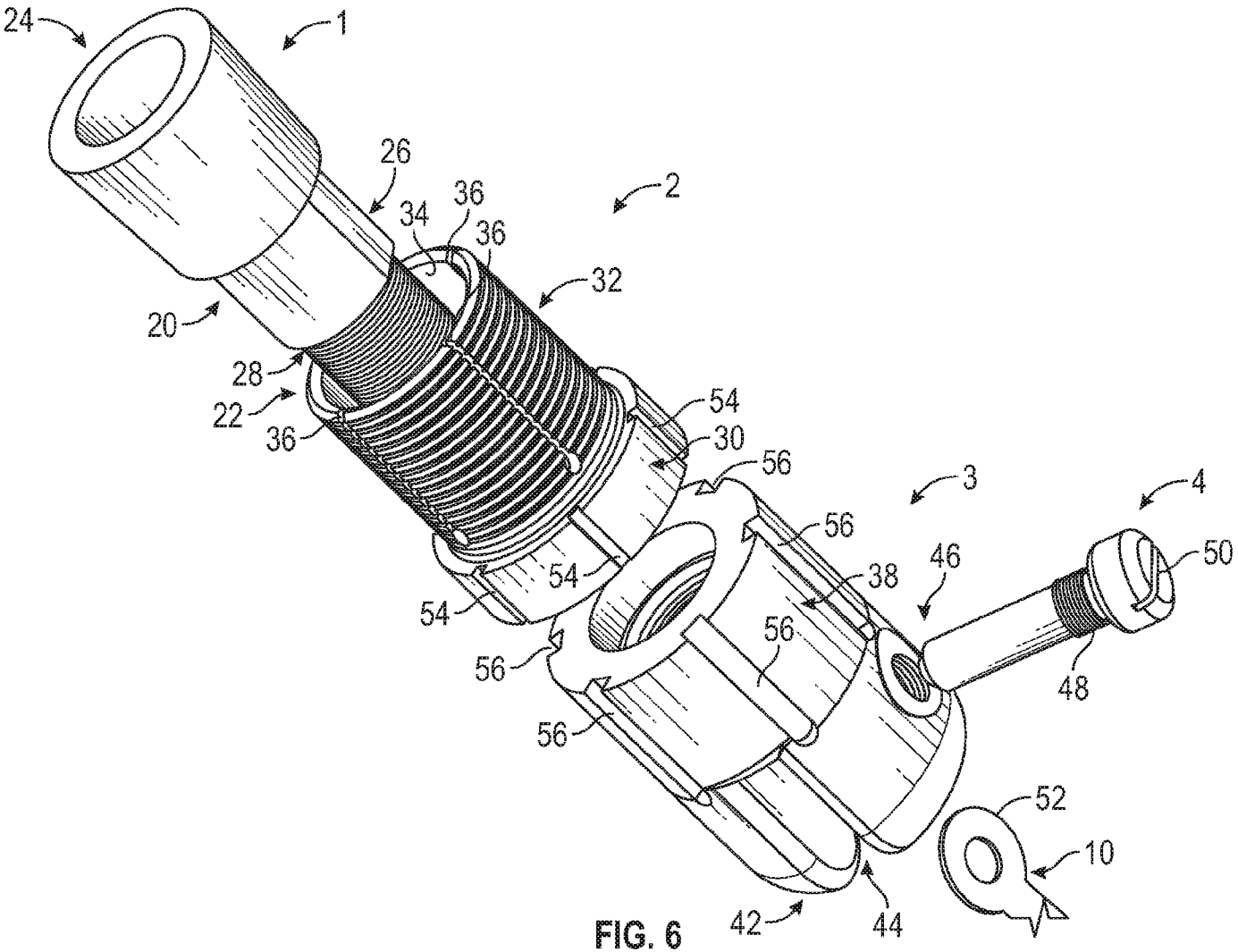
FIG. 6 is a schematic perspective view of a slip connecting head.
Figure 7:
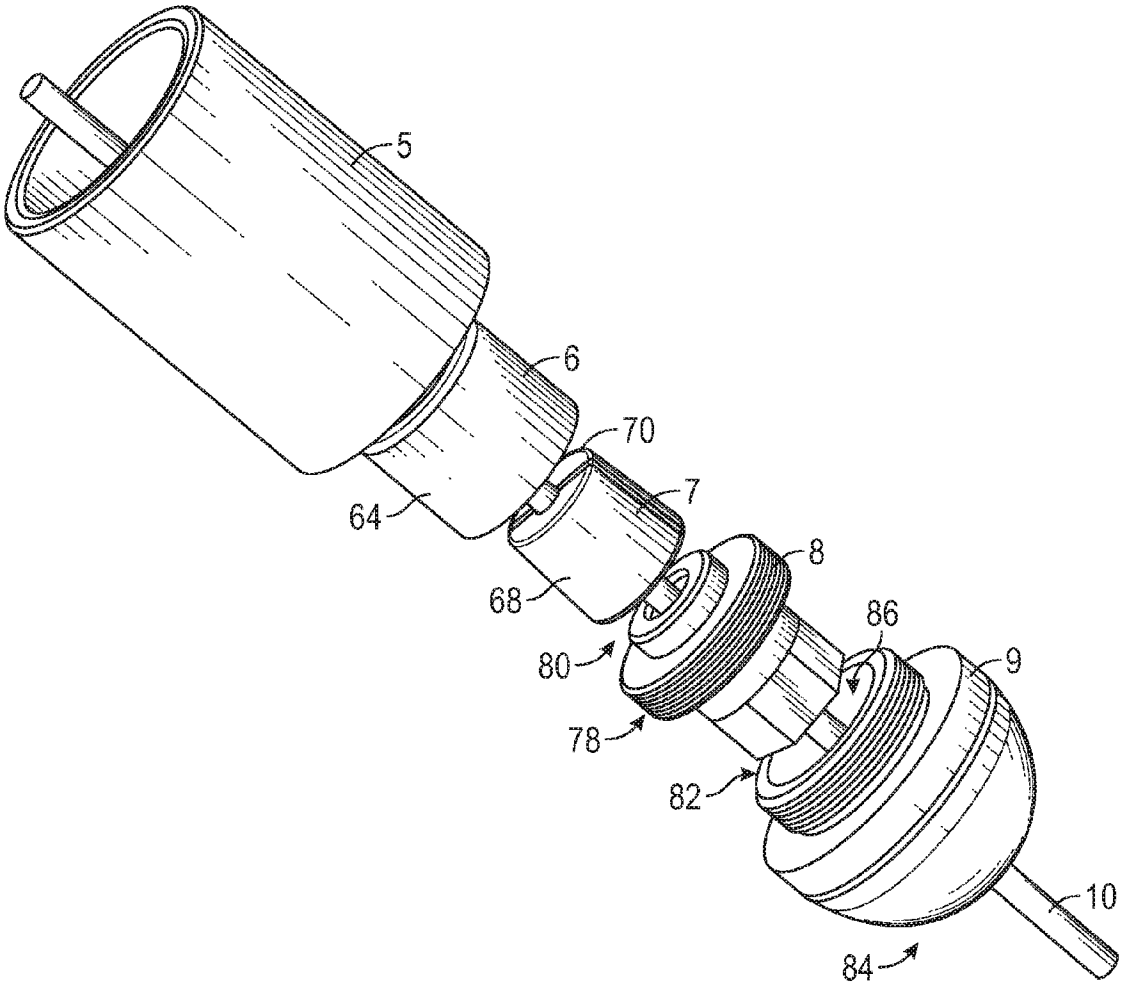
FIG. 7 is a schematic perspective view of a locking sleeve.

The meaning of the numerals in the drawings is as follows: 1—expansion plug, 2—slip sleeve, 3—tightening nut, 4—threaded pin, 5—spherical support body, 6—inner conical sleeve, 7—outer conical clamping sleeve, 8—preloaded nut, 9—spherical head, 10—traction steel rope, 11—conical guide body.

DETAILED DESCRIPTION OF THE INVENTION

Embodiment 1

A coiled tubing guide-in device of with the specification of 2⅜" is used as an example to further describe the present invention in detail.

Referring to FIG. 1, the coiled tubing guide-in device of the present invention mainly consists of a slip connecting head 12, a locking sleeve 14, a floating sleeve 16, a guide head 18, and a traction steel rope 10.

The slip connecting head 12 mainly consists of an expansion plug 1, a slip sleeve 2, and a tightening nut 3. The expansion plug 1 consists of a cone 20 and screw thread body 22. The cone 20 is connected with the screw thread body 22. Center lines of the cone 20 and the screw thread body 22 are on the same straight line. A major diameter end 24 of the cone 20 at an end of the expansion plug 1 is at an external end, that is, a minor diameter end 26 of the cone 20 is connected to an end of the screw thread body 22 of the expansion plug 1, and the screw thread body 22 is cylindrical and is provided with trapezoid external screw threads 28 on an outer wall. The slip sleeve 2 is cylindrical. An outer wall 30 of the slip sleeve 2 is provided with ring teeth 32. A maximum outer diameter of the ring teeth 32 is 0.3 mm smaller than a minimum inner diameter of the 2⅜" coiled tubing. An inner wall 34 of the slip sleeve 2 is a conical surface, and a taper of the conical surface of the slip sleeve 2 is the same as that of the cone 20 of the expansion plug 1. The cone 20 of the expansion plug 1 is in the slip sleeve 2. A wall of the slip sleeve 2 is provided with four symmetrical axial gaps 36. The screw thread body 22 of the expansion plug 1 is connected with the tightening nut 3, and an upper end surface of the tightening nut 3 contacts with a lower end surface of the slip sleeve 2. An outer wall 38 of the tightening nut 3 is cylindrical with a outer diameter of 60 mm and a total length of 85 mm. Trapezoid inner screw threads 40 T28×2 are provided on an upper end of the tightening nut 3. A lower end of the tightening nut 3 is a convex spherical body 42. The lower end of the tightening nut 3 is provided with a rectangular groove 44 along an axial direction, and the dimension of the rectangular groove 44 is 40 mm×12 mm. The lower end of the tightening nut 3 is provided with a screw hole 46, and the screw hole 46 is perpendicular to the rectangular groove 44 at the lower end of the tightening nut 3. A threaded pin 4 is fixed in the screw hole 46 at the lower end of the tightening nut 3. An end of the threaded pin 4 is a cylinder with a diameter of 12 mm. A middle portion of the threaded pin 4 is connection screw threads 48 M14, and another end thereof is provided with an Allen wrench groove 50. The threaded pin 4 passes through a rope loop 52 of the traction steel rope 10, and an inner diameter of the rope loop 52 of the traction steel rope 10 is 12 mm. An end of the traction steel rope 10 is fixed in the rectangular groove 44 at the lower end of the tightening nut 3. The outer wall 30 at the lower end of the slip sleeve 2 is provided with six wrench grooves 54, and the outer wall at an upper end of the tightening nut 3 is provided with six wrench grooves 56.

The locking sleeve 14 mainly consists of a spherical support body 5, an inner conical sleeve 6, an outer conical clamping sleeve 7, a preloaded nut 8 and a spherical head 9. The spherical support body 5 is cylindrical. An outer diameter of the spherical support body 5 is 60 mm, and a total length thereof is 85 mm. An upper end surface of the spherical support body 5 is a concave spherical surface 58, and a center hole 60 with a diameter of 10 mm is provided at the center of the concave spherical surface 58. A cylindrical space 62 with a diameter of 38 mm is provided at a lower portion of the center hole 60 in the spherical support body 5, and center lines of the cylindrical space 62 and the spherical support body 5 are on the same straight line. The inner conical sleeve 6 and the outer conical clamping sleeve 7 are arranged in the cylindrical space 62. An outer wall 64 of the inner conical sleeve 6 is cylindrical. A conical hole 66 with a taper being 1:8 is provided in the inner conical sleeve 6. The outer conical clamping sleeve 7 is arranged in the conical hole 66 in the inner conical sleeve 6. The outer conical clamping sleeve 7 consists of two same gripper blocks 68, 70. Opposite rear outer walls 72, 74 of the two gripper blocks 68, 70 are conical with a taper being 1:8, and ring teeth 76 are provided on a wall of the center hole. Inner screw threads are provided at the lower end of the spherical support body 5. The preloaded nut 8 is disposed on the inner screw threads of the spherical support body 5. An outer wall of the preloaded nut 8 is provided with screw threads 78. The preloaded nut 8 is provided with a center hole 80, and the traction steel rope 10 is capable of passing through the center hole 80 of the preloaded nut 8. The spherical head 9 is fixed on the inner screw threads of the spherical support body 5; the spherical head 9 is cylindrical. An outer diameter of the spherical head is 60 mm, and is the same as that of the spherical support body 5. The length of the spherical head 9 is 45 nm. A cylinder of M40 external screw threads 82 is protruded from an upper end surface of the spherical head 9, and the external screw threads are capable of being connected to the M40 inner screw threads of the spherical support body 5. A lower end of the spherical head 9 is provided with a convex spherical body 84; the spherical head 9 is provided with a center hole 86. The traction steel rope 10 passes through the center hole 60 of the spherical support body 5, the center hole 78 of the outer conical clamping sleeve 7, the center hole 86 of the preloaded nut 8 and the center hole 86 of the spherical head 9. The convex spherical body 42 at the lower end of the tightening nut 3 is in the concave spherical surface at an upper end of the spherical support body 5.

The floating sleeve 16 is formed of connected screw threads 88 of the spherical support body 5 and the spherical head 9. The traction steel rope 10 passes through the center hole 60 of the spherical support body 5 of the floating sleeve 16 and the center hole 86 of the spherical head 9 of the floating sleeve.

One locking sleeve 14 and one floating sleeve 16 form a group of combined locking body 92, and are connected through the traction steel rope 10; the convex spherical surface 42 is inserted in the concave spherical surface 58. The number of combined locking bodies is 8. A lower end of the floating sleeve 16 at the lowest end is connected with a conical guide body 11 through the traction steel rope 10.

The guide head 18 consists of the spherical support body 5, the inner conical sleeve 6, the outer conical clamping sleeve 7, the preloaded nut 8 and the conical guide body 11. The structure of the guide head 18 is substantially the same as that of the locking sleeve 14, and a difference is that the conical guide body 11 is conical, an upper outer diameter of the conical guide body 11 is the same as an outer diameter of the spherical support body 5, and a lower end of the conical guide body 11 is provided with a convex spherical body 90. The conical guide body 11 is provided with a center hole 92, and the traction steel rope 10 passes through the center hole 92 of the conical guide body 11.

INDUSTRIAL APPLICABILITY

During work, power of an injector head motor of a coiled tubing unit generates a downward injection force through a chain, and the injection force is transferred to the locking sleeve on a traction body through friction between the gripper blocks. The force is then transferred to the traction steel rope 11 on the traction body through the outer conical clamping sleeve 7 in the locking sleeve. The traction steel rope 11 further transfers the force to the threaded pin 4 and the slip connecting head. The slip connecting head transfers the traction force to the coiled tubing through the clamping between the slip sleeve 2 and the inner wall of the coiled tubing, thereby implementing the traction function for the coiled tubing.

The coiled tubing guide-in device of the present invention is capable of fast and safely pulling the coiled tubing out of the tubing reel and guiding the coiled tubing into the injector head gripper blocks through a gooseneck guider. No external power source is used, and the power source is provided by the coiled tubing unit. The spherical surface articulation design is used between sections, so that the articulations of the coiled tubing guide-in device are not locked during work. A flexible steel wire rope is used as a main body of the traction body (which improves the flexibility of the guide-in device as a whole), and a nonferrous metal alloy with a low density, low stiffness and high strength is used as a main material of the guide body (which partially improves the rigidity of the guide-in device). The traction body and the guide body are connected through the outer conical clamping sleeve.

What is claimed is:

1. A coiled tubing guide-in device, mainly comprising a slip connecting head, a locking sleeve, a floating sleeve, a guide head, and a traction steel rope, wherein the slip connecting head mainly consists of an expansion plug, a slip sleeve, and a tightening nut; the expansion plug consists of a cone and a screw thread body, the cone is connected with the screw thread body, center lines of the cone and the screw thread body are on the same straight line, a major diameter end of the cone at an end of the expansion plug is at an external end, a minor diameter end of the cone is connected to an end of the screw thread body of the expansion plug, and the screw thread body is cylindrical and is provided with screw thread body screw threads on an outer wall; the slip sleeve is cylindrical, an outer wall of the slip sleeve is provided with ring teeth, an inner wall of the slip sleeve is a conical surface, and a taper of the conical surface of the slip sleeve is the same as that of the cone of the expansion plug; the cone of the expansion plug is in the slip sleeve; a wall of the slip sleeve is provided with an axial gap; the screw thread body of the expansion plug is connected with the tightening nut, and an upper end surface of the tightening nut contacts with a lower end surface of the slip sleeve; an outer wall of the tightening nut is cylindrical, and an end of the tightening nut is provided with inner screw threads; a lower end of the tightening nut is a tightening nut convex spherical body, and the lower end of the tightening nut is provided with a rectangular groove along an axial direction; the lower end of the tightening nut is provided with a screw hole, and the screw hole is perpendicular to the rectangular groove at the lower end of the tightening nut; a threaded pin is fixed in the screw hole at the lower end of the tightening nut; an end portion of the threaded pin passes through a rope loop of the traction steel rope to fix an end of the traction steel rope in the rectangular groove at the lower end of the tightening nut;

the locking sleeve mainly consists of a spherical support body, an inner conical sleeve, an outer conical clamping sleeve, a preloaded nut and a spherical head; the spherical support body is cylindrical, an upper end surface of the spherical support body is a concave spherical surface, and a spherical support body center hole is provided at the center of the concave spherical surface; a cylindrical space is provided at a lower portion of the spherical support body center hole in the spherical support body, and center lines of the cylindrical space and the spherical support body are on the same straight line; the inner conical sleeve and the outer conical clamping sleeve are arranged in the cylindrical space, an outer wall of the inner conical sleeve is cylindrical, a conical hole is provided in the inner conical sleeve, and the outer conical clamping sleeve is arranged in the conical hole in the inner conical sleeve; the outer conical clamping sleeve consists of two same gripper blocks, opposite rear outer walls of the two gripper blocks are conical, and ring teeth are provided on a wall of the spherical support body center hole; inner screw threads are provided on a lower end of the spherical support body; the preloaded nut is disposed on the inner screw threads of the spherical support body, an outer wall of the preloaded nut is provided with preloaded nut screw threads, the preloaded nut is provided with a preloaded nut center hole, and the traction steel rope is capable of passing through the preloaded nut center hole of the preloaded nut; the spherical head is fixed on the inner screw threads of the spherical support body; the spherical head is cylindrical, an outer diameter of the spherical head is the same as that of the spherical support body, a cylinder of external screw threads is protruded from an upper end surface of the spherical head, and the external screw threads are capable of being connected to the inner screw threads of the spherical support body; a lower end of the spherical head is provided with a spherical head convex spherical body; the spherical head is provided with a spherical head center hole; the traction steel rope passes through the spherical support body center hole, a spherical head center hole of the outer conical clamping sleeve, the preloaded nut center hole and the spherical head center hole; the spherical head convex spherical body at the lower end of the tightening nut is in the concave spherical surface at an upper end of the spherical support body;

the floating sleeve is formed of connected screw threads of the spherical support body and the spherical head, the traction steel rope passes through the center hole of the spherical support body of the floating sleeve and the center hole of the spherical head of the floating sleeve;

one locking sleeve and one or two floating sleeves form a group of combined locking body, and are connected through the traction steel rope; the convex spherical surface is inserted in the concave spherical surface; the number of combined locking bodies ranges from 4 to 15; a lower end of the floating sleeve at the lowest end is connected with a conical guide body through the traction steel rope; and the guide head consists of the spherical support body, the inner conical sleeve, the outer conical clamping sleeve, the preloaded nut and the conical guide body; the structure of the guide head is substantially the same as that of the locking sleeve, and a difference is that the conical guide body is conical, an upper outer diameter of the conical guide body is the same as an outer diameter of the spherical support body, a lower end of the conical guide body is provided with a conical guide body convex spherical body; the conical guide body is provided with a conical guide body center hole, and the traction steel rope passes through the conical guide body center hole.

2. The coiled tubing guide-in device according to claim 1, wherein the outer wall at the lower end of the slip sleeve is provided with six wrench grooves, and the outer wall at an upper end of the tightening nut is provided with six wrench grooves.

3. The coiled tubing guide-in device according to claim 1, wherein the inner screw threads of the tightening nut and the external screw threads of the screw thread body of the expansion plug are trapezoidal screw threads.

4. The coiled tubing guide-in device according to claim 1, wherein an end of the threaded pin is a polish rod, connection screw threads are provided in the middle, and another end is provided with an Allen wrench groove.

* * * * *